US005093814A

United States Patent [19]

Besson et al.

[11] Patent Number: 5,093,814

[45] Date of Patent: Mar. 3, 1992

[54] METHOD FOR PROGRAMMING THE PERPETUAL CALENDAR OF A WATCH AND A WATCH FOR IMPLEMENTING SUCH A PROCESS

[75] Inventors: René Besson; Jean Ortelli, both of Geneva, Switzerland

[73] Assignee: Montres Rolex S.A., Switzerland

[21] Appl. No.: 392,987

[22] PCT Filed: Nov. 10, 1988

[86] PCT No.: PCT/CH88/00208

§ 371 Date: Jul. 11, 1989

§ 102(e) Date: Jul. 11, 1989

[87] PCT Pub. No.: WO89/04512

PCT Pub. Date: May 18, 1989

[30] Foreign Application Priority Data

Nov. 11, 1987 [CH] Switzerland ..... 4385/87

[51] Int. Cl.[5] ..... G04B 19/24

[52] U.S. Cl. ..... 368/31; 368/34

[58] Field of Search ..... 368/28–40, 368/184–189

[56] References Cited

U.S. PATENT DOCUMENTS

| | | | |
|---|---|---|---|
| Re. 27,278 | 1/1972 | Brasher | 368/232 |
| 3,750,385 | 8/1973 | Kocher | 368/41 |
| 3,842,599 | 10/1974 | Kato | 368/41 |
| 4,427,300 | 1/1984 | Groothuis | 368/37 |

*Primary Examiner*—Bernard Roskoski

*Attorney, Agent, or Firm*—Davis, Bujold & Streck

[57] ABSTRACT

A process for programming the perpetual calendar of a watch with analog time display is effected using elements incorporated in the watch. The hand of the watch and the position of the hand is used to indicate the steps of the programming. The operation of the stem places the watch in the program mode. If it is required to program three parameters, namely, the number of the year in a four year cycle, the number of the month of the year and the day of the month; and if the watch has a hand setting stem with three positions, each parameter to be programmed is allocated to a position of the stem and the parameters to be programmed are read from the second hand by allocating to the latter real steps corresponding to stopping positions and non allowable steps corresponding to non stopping positions.

15 Claims, 2 Drawing Sheets

Figure 1:
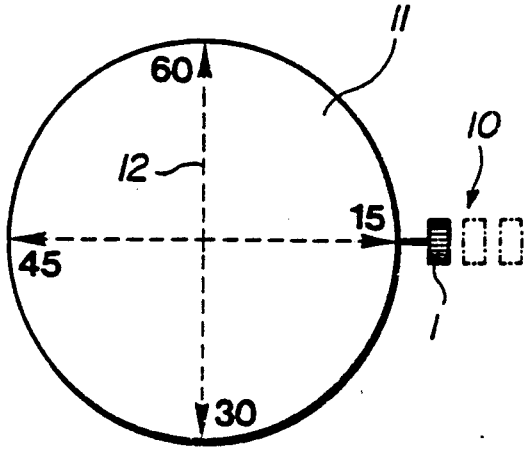

METHOD FOR PROGRAMMING THE PERPETUAL CALENDAR OF A WATCH AND A WATCH FOR IMPLEMENTING SUCH A PROCESS

The present invention concerns a process for programming a perpetual calendar of a watch featuring a perpetual calendar and an analogical time display, in which is programmed at least one of the following parameters of this perpetual calendar: number of the year in a cycle of four years, name or number of the month in the year, day of the month, this watch comprising a case, at least an hour hand, a minute hand and eventually a seconds hand, at least one motor driving these hands together with a quartz-controlled electronic command circuit, means of displaying at least the day of the month and eventually the name of the day, a time-setting rod and an activating mechanism to enter a programming mode, a selecting mechanism and an adjusting mechanism to modify said parameters to be programmed and a display mechanism to visualize said parameters.

It also concerns a watch of the type featuring a perpetual calendar and an analogical time display, comprising a case, at least an hour hand, a minute hand and eventually a seconds hand, at least one motor driving the hands and a quartz-controlled electronic command circuit, means of displaying at least the day of the month and eventually the name of the day, a time-setting rod and the activating mechanism to enter the programming mode, the selecting mechanism and the adjusting mechanism to modify the parameters to be programmed, these parameters being the number of the year in a cycle of four years, the name or the number of the month of the year and the day of the month, and the display mechanism to visualise said parameters, this watch being designed to make use of the above process.

The perpetual calendar of a watch displays the day of the month correctly, allowing for the irregularity of the number of days in the months of the year and also for leap years which have an extra day, i.e. the 29th of February.

All this represents a cycle of four years which does not present any additional irregularities before the year 2100 which will not be a leap year, because of the fact that all the years denoting a century, except those whose first two figures are divisible by four, are not leap years.

To correct these irregularities in a four year cycle, a system must be used where the moment of the correction, whether it be the end of the month and the value to be corrected, whether it be the number of days of each month during four years, are defined.

For a mechanical watch it is sufficient to add to the display of the day of the month, the name of the month and the number of the year in a cycle of four years according to the following scheme:

No. 0 for the leap years i.e. 1984, 1988, 1992, 1996
No. 1 for the years 1985, 1989, 1993, 1997
No. 2 for the years 1986, 1990, 1994, 1998
No. 3 for the years 1987, 1991, 1995, 1999.

The No. of the years corresponds to the remainder from the division by four of the number defining these years.

For a mechanical watch, it is not possible to hide from the wearer the name of the month and the number of the year because this type of watch may stop, for example if the watch is not worn for a certain period, when it is put on again it is necessary to re-date the calendar.

For quartz watches, the situation is completely different given that they continue to function even when they are not worn. Therefore it is possible to consider the name of the month and the number of the year as parameters uniquely accessible by the manufacturer or by a specialist, for example when the battery is changed. By their very nature, electronic systems permit such a conception whereas the mechanical systems can not.

With the aim of unifying the system, it is preferable to add a third parameter, by way of the day of the month, because this avoids a detection of the position of the day of the month disc to define the moment of the correction.

In summary, a watch featuring a perpetual calendar generally comprises three parameters to be programmed which are respectively, the number of the year in a cycle of four years, the name or the number of the month of the year and the day of the month which defines the moment of the correction.

These three parameters are memorised by the electronic circuit and the operation which consists of entering them in the memory is called "programming (setting) the watch".

In existing watches, the programming mode is initiated by means of an apparatus or a device separate from the watch which is only possessed by specialists, i.e. the manufacturer and those watch sellers who are licensed dealers of the manufacturer's make. This is a drawback which causes complications for the customer.

The present invention proposes to obviate this drawback by using a process which makes it possible to abolish the need for a special device to ensure the programming of the perpetual calendar of an electronic analogical watch.

With this aim, the process according to the invention is characterised in that the programming operations are effected exclusively by the said activating, selecting, adjusting and display mechanisms which are integral with the watch.

According to a particular embodiment of the process, the parameters to be programmed are visualised by means of the hands of the watch and the programming mode is entered by means of the time-setting rod.

Preferably, the programming mode is entered by manipulating the time-setting rod in a predetermined way which is different from that required to set the time.

The programming mode may also be entered by means of a contact associated with an electronic circuit or by means of a push piece mounted on the case of the watch.

In this embodiment of the process, the parameters to be programmed are visualised by means of one of the hands of the watch, the movement of this hand is ordered so that some determined number steps are real and correspond to the stop positions of the hand and that some determined number steps are forbidden, these steps not corresponding to the stop positions of the hand, and the stop positions of the hand are coded so that they correspond to the said parameters of the perpetual calendar.

Preferably, the parameter corresponding to the number of the year comprises the following numbers: 0, 1, 2, or 3, the real steps being the following: 15 for the number 1, 30 for the number 2, 45 for the number 3, and 60 for the number 0, all the other steps being forbidden.

The parameter corresponding to the numbers of the month comprises the numbers from 1 to 12, the real steps being the following: 5 for the number 1, 10 for the number 2, 15 for the number 3, 20 for the number 4, 25 for the number 5, 30 for the number 6, 35 for the number 7, 40 for the number 8, 45 for the number 9, 50 for the number 10, 55 for the number 11, and 60 for the number 12, all the other steps being forbidden. The parameter which corresponds to the day of the month comprises numbers ranging from 1 to 28, 29, 30 or 31 depending on the month, the real steps being the following: 1 for the number 1, 2 for the number 2, . . . and 31 for the number 31, all the other steps being forbidden.

The watch according to the invention is characterised in that the said activating, selecting, adjusting and display mechanisms are integral with the watch.

According to one form of a preferred embodiment, the said display mechanism comprise at least one of the hands of the watch, and the said activating mechanism comprise the time-setting rod of the watch or a contact associated with an electronic circuit or a push piece mounted on the case of the watch.

Preferably, the time-setting rod, comprises at least two positions, each one being associated with a parameter to be programmed, these two parameters being the year and the month.

Figure 2:
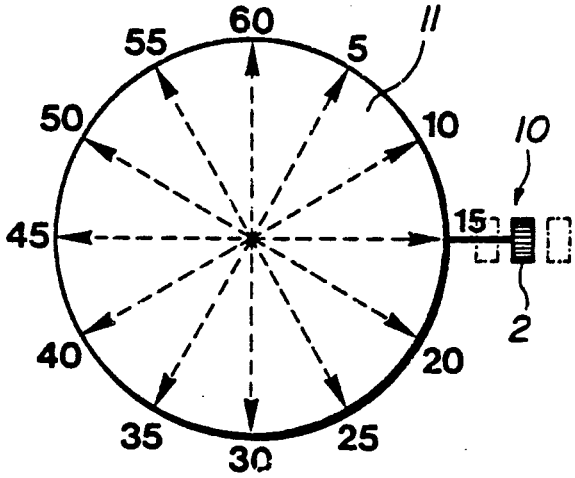
Figure 3:
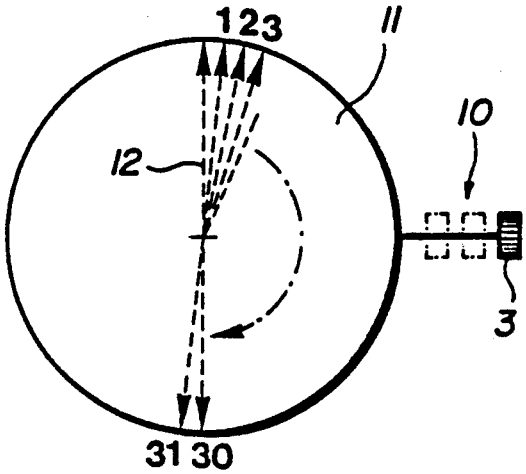
Figure 4:
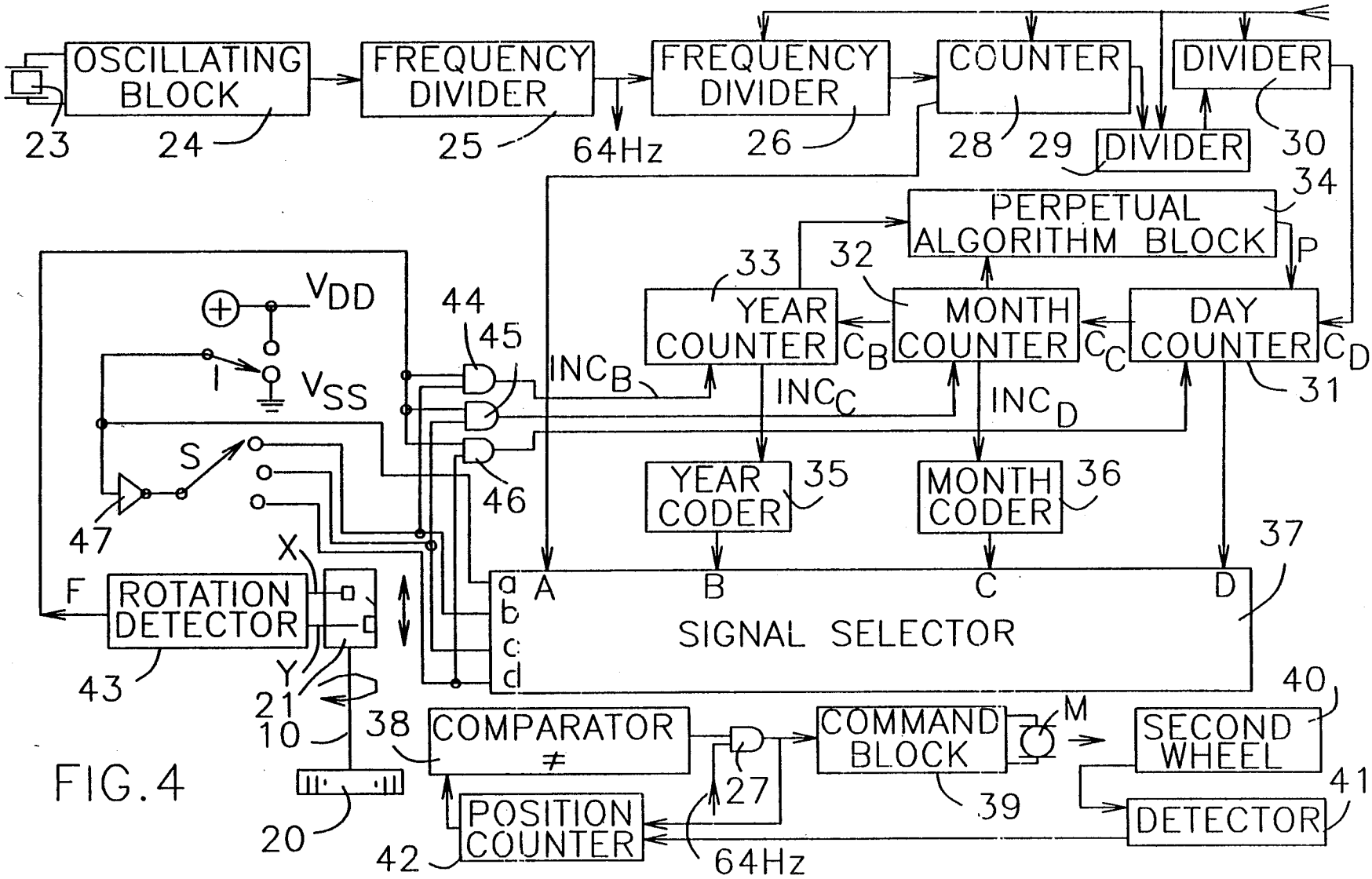

The present invention will be better understood by referring to the description of an example of the preferred embodiment and to the annexed drawings in which:

FIG. 1 represents a schematic view illustrating the process of ordering the programming of the parameter "number of the year" and means of visualising this parameter, FIG. 2 represents a schematic view showing the process of ordering the programming of the parameter "month of the year" and means of visualising this parameter, FIG. 3 represents a schematic view showing the process of ordering the programming of the parameter "day of the month", and means of visualising this parameter, and FIG. 4 illustrates, in the form of a block-schema the electronic circuit of the watch defined above.

In the watch proposed above, the electronic circuit is capable of assuming its normal functions, which consist of driving the progression of the hands and displaying the various indications of the calendar and also, of functionning in programming mode, i.e. to permitting the memorising of the above mentioned parameters.

For this programming mode to be possible, it is essential to have a mechanism which allows the switching of the electronic circuit from the normal operating mode to the programming mode.

In addition, to allow the control of this programming by the operator, the watch must include means of allowing the display of the parameters to be programmed.

According to one preferred embodiment, the visualising of the parameter to be programmed is effected by means of a hand of the watch. The hand chosen is preferably the seconds hand.

The passage from the normal operating mode to the programming mode may be brought about by a contact associated with an electronic circuit. This contact could be a circuit breaker mounted on the printed circuit, a circuit breaker linked with the case, for example initiated by the removal of the back of the case etc. This change of mode may also be brought about by a push piece mounted on the case of the watch.

The solution which has been found to be the best consists of starting the programming mode by means of the time-setting rod of the watch. To avoid the accidental start of the programming mode by a non experienced wearer, a particularly special manipulation of the time-setting rod is used to enter the programming mode, this manipulation being fundamentally different from the usual manipulations required for the routine operations of time adjustment. In the particular case where the time-setting rod comprises three positions, the programming mode may be entered by a manipulation which consists of pulling this time-setting rod successively from position 1 to position 2 to position 3, to return rapidly to position 1 and to repeat the cycle a second time. If the manipulation is correct and if the programming mode is started, the seconds hand moves rapidly and stops on position 15, position 30, position 45 or position 60. If the operator does not see this rapid movement of the seconds hand, he will deduce that the manipulation to start the programming mode was incorrectly carried out and that it must be repeated.

In the example illustrated by FIGS. 1, 2 and 3, the time-setting rod 10 of the watch 11 equipped with a seconds hand 12 comprises three positions 1, 2, and 3. Position 1 corresponds to the first parameter mentioned above, i.e. the number of the year in a cycle of four years, position 2 corresponds to the second parameter, i.e. the number of the month in the year and position 3 corresponds to the third parameter, i.e. the number of the day of the month.

When operating normally, the seconds hand takes sixty steps for each complete cycle, and if each step corresponds to a number from 1 to 60, this hand can program the numbers from 1 to 60 included. For numbers smaller than 60, a combination of real steps and forbidden steps is used, real steps being those on which the hand stops and the forbidden steps being those over which the needle passes without stopping.

In FIG. 1, the time-setting rod 10 is in position 1, i.e. in programming mode, the number of the year may be programmed. Given that a cycle comprises four years to which the numbers 0, 1, 2 or 3 are attributed, the real steps of the seconds hand 12 are 15 for the number 1, 30 for the number 2, 45 for the number 3 and 60 for the number 0 which, as mentioned before, corresponds to the leap years. All other steps are forbidden.

When the time-setting rod 10 is in position 2 as shown in FIG. 2, the parameter to be programmed is the number of the month which varies from 1 to 12. Accordingly, the following real steps have been chosen: 5 for the number 1, 10 for the number 2, 15 for the number 3, 20 for the number 4, 25 for the number 5, 30 for the number 6, 35 for the number 7, 40 for the number 8, 45 for the number 9, 50 for the number 10, 55 for the number 11 and 60 for the number 12. All other intermediate steps are forbidden.

FIG. 3 shows the programming of the days of the month. The time-setting rod 10 is in position 3. The real steps going from 1 to 31 have been chosen so that the seconds hand can occupy all the positions going from 1 to 31. All the other steps are forbidden.

It is observed that according to this embodiment, each parameter corresponds to a well defined position of the time-setting rod and to a very characteristic combination of real steps and of forbidden steps of the seconds hand.

For example, after a change of battery, the pressing of the circuit generates the state: "January 1st of a leap year". From this information, the operator has to programme the complete date by turning the crown anticlockwise for each position of the rod. For example, to programme the date August 4th. 1987, the following operations must be carried out:

a) enter the programming mode by one of the previously described ways
b) bring the time-setting rod into position 1, then turn the rod until the seconds hand is on 9 o'clock, i.e. in the position of the real step 45 which corresponds to the year number 3.
c) bring the time-setting rod into position 2, then turn the rod until the seconds hand is on the position 8 o'clock, i.e. on the real step 40 which corresponds to the eighth month of the year.
d) bring the time-setting rod into position 3, then turn it until the seconds hand is on the real step 4 corresponding to the fourth day of the month.

If the operator goes past the required value he must continue turning in the same sense until the correct value is reached. A rotation of the crown in the opposite sense, i.e. in a clockwise direction is invalid. This process allows the crown to be screwed on without changing the programming.

It is also noted that exiting from the programme occurs automatically after a predetermined delay, for example ten seconds after the last manipulation.

If a correction of the date of the month or the name of the day is necessary, for example when the battery is changed, this is carried out by the normal means of correction of the day and name of the month.

The operator must, of course, check that the day displayed corresponds to the day programmed.

At the moment of entry into the programming mode, the said correction means, i.e. correction of the time, the correction of the day of the month and eventually that of the time-zone, are unusable.

It is understood that various modifications could be applied to the above watch. The programming of the three parameters by means of the time-setting rod is facilitated by the fact that this rod has three positions. In the case of a rod which has two positions, one of the parameters can be programmed by another element or by a sequential arrangement, a push piece or any other known device.

In this last case, the programming of the day could be replaced by a detector of the position of the day disc.

Referring to FIG. 4, the electronic circuit comprises all the elements necessary for the execution of a perpetual calendar, i.e. to successively enter the years, the months and the days in the electronic memory by means of the switch I which allows entry into the programming mode, the crown 20 connected to the time-setting rod 10 which has three positions, a position and rotation sensing element 21 which generates rotation impulsions of the crown in tho positive sense, to deliver these impulsions F, and the seconds hand 12 whose position successively indicates the year, the month and the day of the month as described for the preceding figures. The command mechanisms for the hour hand and the minute hand, together with the command mechanism of the day discs and eventually of the name of the day, which are well known by those skilled in the art, are not represented in this scheme.

Referring to this scheme, the electronic circuit comprises first of all a quartz resonator 23 which is a standard quartz at a nominal frequency of 32.768,0 Hz. It is associated with an oscillating block 24 which maintains and emits oscillations of the nominal frequency and supplies an alternating signal at this frequency to a frequency divider 25 of nine layers of dividers by two. At its exit it provides a logical signal of 64 Hz. This signal is transmitted to a frequency divider 26 of six layers of dividers by two and to a door "AND" 27. This divider 26 provides at its exit a signal of 1 Hz, i.e. a period of one second, to a counter 28, called a sixties counter, which keeps count of the seconds or in other words constitutes the permanent electronic memory of a precise second. This counter is connected to two dividers 29 and 30 which divide respectively by 60 and 24. The divider 30 allows the provision at its exit of one impulsion $C_D$ per twenty four hours.

The counter 30 is connected to a divider 31 called day counter which counts from 1 to 28, 29, 30 or 31 according to the command P which provides it with a block 34 called perpetual algorithm which will be described below. Each impulsion $C_D$ increases the counter by one unit: in case the capacity is exceeded (i.e. 28, 29, 30 or 31) the new value taken is 1 and a signal $C_C$ is generated at its exit to command a counter of months 32 which counts from 1 to 12. It is increased by the entry signal $C_C$; in case its capacity is exceeded (12), the new value taken is 1 and a signal $C_B$ is generated at its exit to command a year counter 33. The counter 32 also furnishes its own state (1 to 12) to the perpetual algorithm 34.

The year counter counts from 0 to 3, (the year 0 being a leap year). It is increased by the entry signal $C_B$, when the capacity (3) is exceeded, the new value taken is 0. This counter also furnishes its own state (0 to 3) to the perpetual algorithm 34.

The perpetual algorithm 34 comprises the means necessary for the calculation of the number of days, of the month, of the year which it is provided with by the counters 32 and 33. For example year 0, month 2 (February in a leap year) corresponds to 28 days. The signal P provided by this block 34 to the day counter 31 gives the maximum counting value to this latter which is, in the above example, 28.

The counter 33 is coupled with a year coder 35 which comprises combinative logical elements which allow the correspondence of the values from the year counter 33 with the values corresponding to the image of the position of the seconds hand of a position counter 42 of this latter, and which will be described in further detail later, according to the following correspondences: for the entry values 0, 1, 2 and 3, the exit values 60, 15, 30 and 45, as has been explained with reference to FIG. 1.

Similarly, the counter 32 is coupled to a month coder 36 which comprises combinative logical elements which allow the correspondence of the values from the month counter 32 with the values corresponding to the image of the position of the seconds hand of a position counter 42 of this latter, according to the following correspondences: for the entry values, 1, 2, . . . , and 12, the exit values 05, 10, . . . , and 60, as has been explained with reference to FIG. 2.

The year coder 35 and the month coder 36 together with the day counter 31 and the counter 28 are connected to a signal selector 37 which allows the selection of one from these four sources of information: sixties counter 28, year coder 35, month coder 36 and day counter 31, selection commanded by one of the four entry signals, a, b, c, d, of which the first a, is generated by the switch I and the three others b, c and d correspond to the three axial positions of the time-setting rod. One of the other signals A, B, C, or D, emitted respectively by the counter 28, the coder 35, the coder 36 or the counter 31 is thus directed at the exit of the selector 37 on one of the entries of a comparator 38.

This comparator 38 provides an exit signal to the logical level 1 at one of the two entries of the door "AND" 27, as long as the entry signals coming on the one hand from the selector 37 and on the other hand, from the position counter of the seconds hand position 42 are different. Once the two entry signals are identical, the exit signal reverts to the logical level 0. This door "AND" is linked by its exit to a command block 39 of the motor M. It is designed to assure the excitation of this motor by steps, each one of which corresponds to a second.

The motor M is linked to a seconds wheel 40 which drives the seconds wheel linked to the seconds hand 12. At each step of the motor M the seconds wheel travels a distance corresponding to an angle of 6 degrees, i.e. one sixtieth of a turn.

A detector 41 of the position of the seconds wheel unequivocally discriminates a single position of the seconds wheel from the sixty which are possible. This particular position corresponds to the orientation of the seconds hand on the index 00 on the face of the watch (12 noon). The exit signal passes to the logical level 1 when this particular position is detected; it orders the return to zero of the position counter 42 of the seconds hand 12.

The position counter 42 of the seconds hand memorises the current position of this latter. 00 corresponds to the position 0 on the watch face. The capacity of this counter ranges from, 00, corresponding to position 0 on the watch face, and 59 corresponding to the position 59 on the watch face. The state of the counter is given to one of the two entries of the comparator 38.

The "impulse generator" with—position and rotation sensing element 21 transmits the signals X and Y to a rotation detector 43, by means of two contacts opening and closing sequentially during the rotation of the winding rod. This rotation detector generates a signal F during an anti-clockwise rotation of this rod; this signal passes from the logical state 0 to the logical state 1 and inversely at each opening, or respective closing of the above mentioned contacts. This signal F is passed to one of the two entries of each of the three doors "AND" 44,45 and 46 whose purpose will be described below.

As mentioned before, the winding rod can move axially between three distinct positions. One of these three positions is detected by means of the selector S which has three contacts providing the signals b, c and d. The sequential opening and closing of the two contacts of the impulse generator 21, generates said signals X and Y described above.

The three doors "AND" 44, 45 and 46 have one of their common entries linked to the rotation detector 43 of the crown 20. They receive the signal F generated by this detector. The selector S connects the exit of a reverser 47 to the other entry of one of the three doors 44, 45 or 46, the two non-connected entries always staying at the logical level "0".

The door "AND" 27 with two entries permits the control of the passage of the logical signal of 64 Hz delivered by the frequency divider 25. If the comparator 38 has not detected identitical signals, it provides a high level logical signal to one of the two entries of the door "AND"; the door allows the signal 64 Hz to pass by the second entry. The signal of 64 Hz orders the advance of the motor and the increase of the counter of the position of the seconds hand, this latter advancing rapidly. Once the comparator detects identitical signals, it provides a low level logical signal; the door 27 no longer allows the signal 64 Hz to be passed. This has the effect of stopping the seconds hand in the position corresponding to the equality detected.

The reverser 47, mentioned before, allows the formulation of the signal coming from the programming interruptor I. In normal mode, the interruptor I is connected to the positive supply $V_{DD}$, the exit of the reverser being therefore in a low level logical state, consequently none of the three doors 44, 45 or 46 can allow the passage of the signal F. The signal at the entry of the reverser and at the entry a of the selector 37 is at a high logical level, the selector choosing the signal A coming from the seconds counter 28. In programming mode, the interruptor I is connected to the potential $V_{SS}$, representing the mass; the exit of the reverser is thus in the logical state "1". One of the three signals a, b or c is thus at a high logical level (following the axial position of the winder rod). If b is at 1, an anti-clockwise rotation (signal F present) produces an increase in the year counter 33 by the signal $INC_B$ coming from the door "AND" 44. If c has a value of 1, a similar rotation causes an increase in the month counter by the signal $INC_C$, coming from the door "AND" 45, but without result if the capacity is exceeded ($C_B$ is not activated). If d is at 1, a similar rotation causes an increase in the day counter by the signal $INC_D$, produced from the door "AND"46, without reply if the capacity is exceeded ($C_C$ is not activated).

This form of the embodiment is given by way of a non-limiting example, and even though the functions are perfectly defined and unchangeable in the frame of the process according to the invention, the components may be modified or replaced by equivalent components.

I claim:

1. A method of setting a calendar operation feature of a watch, having a therein perpetual calendar program storing day, month, and four year leap year cycle information, to display current calendar information, in which the watch comprises:

an exterior casing;

an hour hand and minute hand movable over a watch face carrying indicia;

motor means, together with a quartz-controlled electronic command circuit, for driving the hands;

the perpetual calendar program allowing selection of all of the following parameters when in a setting mode: a number representing the current year of the four year leap year cycle, a name or number of the current month of the current year, and the current day of the current month, whereby the watch, when in a calendar display mode, will display the current calendar information;

an analog time display utilizing the hands;

means for displaying the current day of the current month;

a time-setting rod connected to move the hands; and means for activating the setting mode of the perpetual calendar program, means for selecting the parameter to be entered into the peripheral calendar program, means for adjusting each selected parameter, and means for displaying the parameter selected utilizing one of the hands and the indicia on the watch face;

the method comprising the steps of activating the setting mode, selecting each parameter to be entered, adjusting each parameter to be entered and displaying each parameter selected exclusively for operation of said activating means, said selecting means, said adjusting means and said display means all of which are integral with the watch.

2. A method according to claim 1, further comprising the step of displaying each parameter to be entered by means of one of the hands of the watch.

3. A method according to claim 1, further comprising the step of utilizing movement of the time-setting rod for operation of said activating means, said selecting means, said adjusting means and said display means.

4. A method according to claim 1, further comprising the step of activating the setting mode by manipulating the time-setting rod in a manner which is different from that required to set the time of the watch.

5. A method according to claim 1, further comprising the steps of:

displaying each parameter to be entered by means of one of the hands of the watch, controlling movement of that one hand so that a predetermined number of steps of that hand are real and correspond to stop positions of that hand and a predetermined number steps of that hand are not allowed, these steps not corresponding to the stop positions of the hand, and coding the step positions of the hand so that they correspond to parameters of the perpetual calender.

6. A method according to claim 5, further comprising the step of controlling that hand to correspond to a number of the current year comprising one of the following numbers: 0, 1, 2 or 3, in which the real steps of that hand are as follows: 15 for the number 1, 30 for the number 2, 45 for the number 3, and 60 for the number 0, all other steps are not allowed.

7. A method according to claim 5, further comprising the step of controlling that hand to correspond to a number of the current month comprising a number ranging from 1 to 12, inclusive in which the real steps of that hand are as follows: 5 for the number 1, 10 for the number 2, 15 for the number 3, 20 for the number 4, 25 for the number 5, 30 for the number 6, 35 for the number 7, 40 for the number 8, 45 for the number 9, 50 for the number 10, 55 for the number 11, and 60 for the number 12, all other steps are not allowed.

8. A method according to claim 5, further comprising the step of controlling that hand to correspond to a number of the current day of the current month comprising a number ranging from 1 to 28, 29, 30 or 31, inclusive, depending on the number of days in the current month, in which the real steps of that hand are as follows: 1 for the number 1, 2 for the number 2, 3 for the number 3, 4 for the number 4, . . . , and 31 for the number 31, all other steps are not allowed.

9. A method according to claim 1, in which the watch additionally includes a movable second hand, and the method further comprising the step of utilizing the position of the movable second hand to display each parameter entered.

10. A watch comprising, comprising an exterior casing, an hour hand and a minute hand forming, with a watch face carrying indicia, an analog time display, motor means, together with a quartz-controlled electronic command circuit, for driving the hands, a perpetual calendar program storing day, month, and four year leap year cycle information, means for displaying at least one of current day, current month and current year information, a time-setting rod connected to move the hands, means for activating a setting mode of the perpetual calendar program, means for selecting parameters to be entered into the perpetual calendar program, the parameters to be entered being a number in a cycle of four years representing the current year of a four year leap year cycle, a name or number of the current month of the current year and the current day of the current month, means for adjusting each selected parameter, and means for displaying each parameter being entered utilizing one of the hands and the indicia on the watch face, wherein said activating means, said selecting means, said adjusting means and said display means are all integral with the watch.

11. A watch according to claim 10, wherein said display means comprises manipulation the time-setting rod in combination with at least one of the hands of the watch and the indicia carried by the watch face.

12. A watch according to claim 10, wherein said activating means comprises the time-setting rod of the watch interacting with a position and rotation sensing element connected to the perpetual calendar program.

13. A watch according to claim 12, wherein the time-setting rod has at least first and second positions in which parameters of the perpetual calender can be entered, when the time-setting rod is in the first position parameters concerning the year can be entered and when the time-setting rod is in the second position parameters concerning the month can be entered.

14. A watch according to claim 10, wherein a movable second hand is provided on the watch and the movable second hand is said display means for displaying each parameter entered.

15. A watch comprising, comprising an exterior casing; an hour hand and a minute hand forming, with a watch face carrying indicia, an analog time display; monitor means, together with a quartz-controlled electronic command circuit, for driving the hands; perpetual calendar means for storing and determining day, month, and four year leap year cycle information; means for displaying at least one of current day, current month and current year information; a time-setting rod connected to move the hands over the watch face; a mechanism, connected with the perpetual calendar means, for activating a setting mode of the perpetual calendar means, said mechanism further including means for selecting and adjusting parameters to be entered into the perpetual calendar means, the parameters to be entered being a number in a cycle of four years representing the current year of a four year leap year cycle, a name or number of the current month of the current year and the current day of the current month, and means for displaying each parameter being entered utilizing one of the hands and the indicia on the watch face, wherein said mechanism for activating a setting mode, including said selecting and adjusting means, and said display means are all integral with the watch.

* * * * *

UNITED STATES PATENT AND TRADEMARK OFFICE

CERTIFICATE OF CORRECTION

PATENT NO. : 5,093,814

DATED : March 3, 1992

INVENTOR(S) : Rene BESSON & Jean ORTELLI

It is certified that error appears in the above-identified patent and that said Letters Patent is hereby corrected as shown below:

Column 8, line 66 replace "peripheral" with --perpetual--.

Column 9, line 6 replace "for" with --by--; and
line 44 after "inclusive" insert --,--.

Column 10, line 44 replace "monitor" with --motor.

Signed and Sealed this

Fourth Day of May, 1993

*Attest:*

Michael K. Kirk

MICHAEL K. KIRK

*Attesting Officer*

*Acting Commissioner of Patents and Trademarks*